United States Patent [19]

Borrevik et al.

[11] 3,958,483

[45] May 25, 1976

[54] MUSICAL INSTRUMENT RHYTHM PROGRAMMER HAVING PROVISION FOR AUTOMATIC PATTERN VARIATION

[75] Inventors: Alexander J. Borrevik, Babylon, N.Y.; Robert B. Cotton, Jr., Sunnyvale, Calif.; Robert G. Mathias, Brookfield, Ill.

[73] Assignee: Hammond Corporation, Chicago, Ill.

[22] Filed: Nov. 1, 1974

[21] Appl. No.: 519,872

Related U.S. Application Data

[63] Continuation-in-part of Ser. No. 352,912, April 20, 1973, abandoned.

[52] U.S. Cl. ..... 84/1.03; 84/DIG. 12

[51] Int. Cl.[2] ..... G10H 1/00; G10H 5/00

[58] Field of Search ..... 84/1.01, 1.03, 1.17, 84/1.24, DIG. 12, DIG. 22

[56] References Cited

UNITED STATES PATENTS

| | | | |
|---|---|---|---|
| 3,549,774 | 12/1970 | Bunger | 84/1.03 |
| 3,585,891 | 6/1971 | Schwartz et al. | 84/1.03 |
| 3,624,263 | 11/1971 | Uchiyama | 84/1.03 |
| 3,629,480 | 12/1971 | Harris | 84/1.03 |
| 3,707,594 | 12/1972 | Ichikawa | 84/1.03 |
| 3,708,602 | 1/1973 | Hiyama | 84/1.03 |
| 3,740,449 | 6/1973 | Southard | 84/1.01 |
| 3,760,088 | 9/1973 | Nakada | 84/1.03 |
| 3,763,305 | 10/1973 | Nakada et al. | 84/1.03 |
| 3,764,722 | 10/1973 | Southard | 84/1.03 |

*Primary Examiner*—L. T. Hix
*Assistant Examiner*—Stanley J. Witkowski
*Attorney, Agent, or Firm*—Lowell C. Bergstedt

[57] ABSTRACT

An automatic rhythm programmer for an electrical musical instrument which provides electrical pulses for actuating musical voice generators according to predetermined rhythmic patterns, having provision for introducing any one of several predetermined variations into any basic rhythmic pattern and for automatically changing from one variation to another at a preselected rate. The programmer comprises a master oscillator, a first counter and an electronic commutator which periodically pulse in sequence a series of address lines in an integrated circuit read-only memory, which also contains a separate series of tracks for each basic rhythmic pattern, each track being in circuit with certain of the address lines and energized at predetermined times therefrom, each track also being connected to certain of the voice generators and operable to provide actuating pulses thereto. In order to provide pattern variations, the read-only memory further contains a series of track variation lines, each corresponding to a particular pattern variation, which can be energized either manually or periodically in sequence by a variation counter at a preselected rate, each track variation line being in circuit with certain of the tracks and operable when energized to cancel or enable certain actuating pulses to the voice generators, whereby the rhythmic patterns developed at the voice generators are varied either manually or automatically according to the energization of the track variation lines.

16 Claims, 8 Drawing Figures

PATTERN SWITCHES
27
PATTERN ENABLE LINES
28
I C CHIP
14
READ-ONLY MEMORY
18
21
19
VOICE GENERATORS
23
22
AMPLIFIER
26
SPEAKER
24
13
17
29
ADDRESS DECODER
TRACK VARIATION DECODER
31
TRACK VARIATION DECODER INPUT LEADS
33
32
VARIATION COUNTER
42
41
VARIATION SWITCHES
38
39
ADDRESS DECODER INPUT LEADS
16
ON-OFF SWITCH
36
37
MEASURE SELECT SWITCH
34
35
COUNTER
11
12
MASTER OSCILLATOR
10

BASS DRUM
CYMBAL
SNARE DRUM
BONGO
CONGA
COW BELL
CHORD
TRACK VARIATION DECODER
VARIATION DECODER MATRIX
INVERTER
MEASURE 1
MEASURE 2
VARIATION A B C D
+V
PATTERN ENABLE LINE
ADDRESS LINES TO OTHER TRACK GROUPS
ADDRESS DECODER

TO REMAINDER OF 179 BY 12 R.O.M.
CHORD
COW BELL
CONGA
BONGO
SNARE DRUM
CYMBAL
BASS DRUM
TO REMAINDER OF 46 BY 179 READ ONLY MEMORY
TRACK VARIATION DECODER
10 BY 24 READ ONLY MEMORY ADDRESS DECODER
-V
VDD

MUSICAL INSTRUMENT RHYTHM PROGRAMMER HAVING PROVISION FOR AUTOMATIC PATTERN VARIATION

CROSS-REFERENCE TO RELATED APPLICATION

This application is a continuation-in-part of pending application Ser. No. 352,912 filed on Apr. 20, 1973, and now abandoned.

BACKGROUND OF THE INVENTION

1. Field of the Invention OF THE INVENTION

This invention relates to an automatic rhythm programmer used for actuating electrical musical voice generators to provide musical instrument rhythm sounds according to predetermined rhythmic patterns.

2. Description of the Prior Art

There are a number of automatic rhythm programmers in use which provide electrical pulses for actuating a group of electrical musical voice generators according to repeated preselected rhythmic patterns, such as the waltz, dixieland, march, etc. Such voice generators comprise known electrical circuits which, when pulsed, produce, in conjunction with an audio output system, various untuned musical sounds of the type usually associated with the percussion section of an orchestra which are useful to provide rhythm background accompaniment for an electrical musical instrument such as an electronic organ. See, for example, the following U.S. Pat. Nos. which are believed to be representative of the current state of the art:

| | |
|---|---|
| Richard H. Campbell, Jr. | 3,358,068 |
| Donald M. Park et al. | 3,383,452 |
| Donald M. Park | RE. 26,521 |
| Alfred B. Freeman | 3,548,065 |
| Alfred B. Freeman | 3,553,334 |
| Harold O. Schwartz | 3,585,891 |

The devices disclosed in all of the above patents produce actuating pulses for voice generators according to any selected one of a number of basic rhythmic patterns which are continuously repeated without any variation. However, such basic patterns sound monotonous after being played for any length of time. The present invention eliminates such monotony by providing a method for automatically modifying or cancelling actuating pulses for certain non-essential voice generators periodically while maintaining the basic rhythmic patterns.

The manual or automatic introduction of variations into any of the basic rhythmic patterns could not be economically provided using the systems of any of the above patents. The Campbell, Park and Freeman patents teach means for generating and supplying pulses to a logic matrix which combines the pulses according to different rhythmic patterns and has output terminals which are selectively switched to certain voice generators according to the desired rhythmic pattern; since the same matrix is used for all of the rhythmic patterns, a method for selectively switching the matrix to the voice generators for each combination of a basic rhythmic pattern and one or more pattern variations is not economically possible with these systems.

The Schwartz system, while designed to reduce the cost and size of rhythm programmers, contains a complex logic circuit using solid-state integrated circuit components which, nevertheless, requires 14 integrated circuit chips to provide only 5 basic rhythmic patterns, with no provision for pattern variation.

SUMMARY OF THE INVENTION

The present invention has provision for introducing any one of several predetermined variations into any basic rhythmic pattern and for automatically changing from one variation to another at a preselected rate. The introduction of automatic pattern variations in an automatic rhythm programmer requires, according to the teachings of the present invention, a semiconductor read-only memory, which economically performs complex logic functions. The preferred embodiment of the present invention requires only one integrated circuit package containing the read-only memory and some associated circuitry, yet has the capability for at least 16 basic rhythmic patterns with four pattern variations.

The read-only memory used in the present invention contains a series of address lines which are periodically energized in sequence by pulses supplied from a master oscillator, a counter and an electronic commutator. The read-only memory further contains a separate series of tracks for each basic rhythmic pattern, each track being in circuit with certain of the address lines and energized at predetermined times therefrom, and each track also being connected to certain of the voice generators and operable to provide actuating pulses thereto. In order to provide pattern variations, the read-only memory further contains a series of track variation lines, each corresponding to a particular pattern variation, which can be energized either manually or periodically in sequence by a variation counter at a preselected rate, each track variation line being in circuit with certain of the tracks and operable when energized to cancel or enable certain actuating pulses to the voice generators, whereby the rhythmic patterns developed at the voice generators are varied either manually or automatically according to the energization of the track variation lines. Although the use of a separate series of tracks for each rhythmic pattern might appear unnecessarily complex, in addition to providing automatic pattern variation, the preferred embodiment of the present invention has size and cost advantages over systems of the prior art through the use of metal-oxide-semiconductor field-effect transistors (MOSFETs) in large-scale integrations.

The preferred embodiment includes four manually operable variation switches, each corresponding to a particular pattern variation and each being selectively operable to energize a corresponding track variation line in order to manually select one of four pattern variations; these switches can introduce any one of the variations into any basic rhythmic pattern at any given time. Further switches are provided for automatically changing from one variation to another beginning at any given time and at a preselected rate varying from two complete cycles of four variation changes in one measure of music to one variation change every sixteen measures, in order to provide the operator with a wide range of flexibility in varying each basic rhythmic pattern.

DESCRIPTION OF THE PREFERRED EMBODIMENTS

Figure 1:
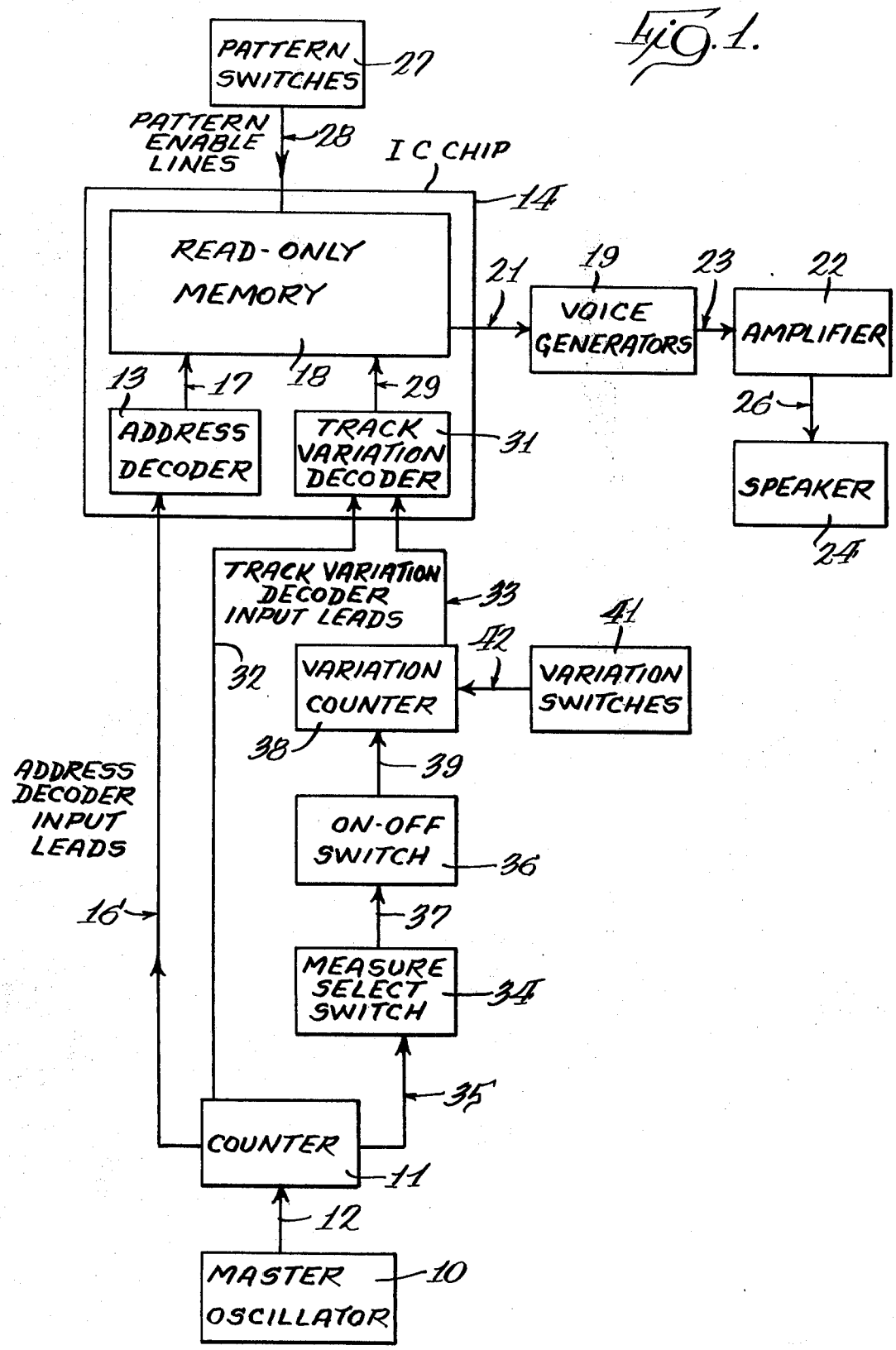
FIG. 1 is a simplifed block diagram showing the basic features of the preferred embodiment of the present invention.

Turning now to the embodiment of the present invention illustrated in the accompanying drawings, reference is initially made to FIG. 1, which illustrates the preferred embodiment in simplified block form. Considering the system generally, a master oscillator 10 comprises a conventional multivibrator which produces a continuous series of square wave electrical pulses at regular preselected time intervals, the pulses being supplied to a counter 11 by a lead 12. The counter 11 comprises a group of series-connected stages, outputs thereof being connected to an electronic commutator or address decoder 13 by means of five address decoder input leads 16. The address decoder 13 is operable to periodically energize in sequence 24 address lines 17 of a pattern memory storage means or a read-only memory 18 with pulses supplied from the counter 11. The address decoder 13 is preferably contained within the integrated circuit chip 14 in order to minimize the number of input leads to the chip, as the number of address lines 17 (24) far exceeds the number of address decoder input leads 16 (five).

As will be fully described later, the read-only memory 18 comprises a series of tracks for each basic rhythmic pattern, each track being in circuit with certain of the address lines 17 and energized at predetermined times therefrom, each track also being connected to certain of the voice generators 19 by leads 21 and operable to provide actuating pulses thereto.

The voice generators 19 comprise known circuits for producing untuned musical sounds of the type usually associated with the percussion section of an orchestra, such as the bass drum, cymbal, brush, snare drum, claves, bongo, conga, cow bell, rimshot, sand block, or a drum roll. The outputs of the voice generators 19 are connected to an audio amplifier 22 by means of leads 23. The audio amplifier 22 in turn supplies a speaker 24 through leads 26.

The preferred embodiment of the present invention has provision for operating the voice generators according to any one of sixteen basic rhythmic patterns: the waltz, march, polka, western, ballad, jazz, blues rock, hard rock, liverpool, rhumba, bassa nova, cha-cha, beguine, tango, afro latin and dixieland. Each such pattern has an associated group of tracks in the read-only memory 18. Any one of 16 pattern switches 27 is selectively operable to enable one corresponding basic rhythmic pattern by means of sixteen corresponding pattern enable lines 28, each pattern enable line being in circuit with a corresponding group of tracks.

In order to provide pattern variations, the read-only memory 18 further contains six track variation lines 29, each being in circuit with certain of the tracks and operable when energized to cancel or enable certain actuating pulses to the voice generators, whereby the rhythmic pattern developed at the voice generators are varied according to the energization of the track variation lines.

The track variation lines 29 are supplied by a track variation decoder 31 which is operable to decode the logic information on three track variation decoder input leads denoted at 32 and 33, to energize the track variation lines 29, the track variation decoder 31 being preferably contained within the integrated circuit chip 14 in order to minimize the number of chip input leads, since the number of track variation lines (six) exceeds the number of track variation decoder input leads 32 and 33 (three).

The output of one stage of the counter 11 is connected to the track variation decoder 31 by track variation decoder input lead 32, and is operable to vary the rhythmic patterns periodically from measure to measure, in a manner to be described in detail later. The outputs of certain stages of the counter 11 are connected to a multiple-position measure select switch 34 by a group of leads 35, the measure select switch being selectively operable to couple the output of any one of such stages to an on-off switch 36 by a lead 37, the on-off switch 36 being operable to connect the output of the measure select switch 34 to a variation counter 38 by a lead 39. The variation counter 38 is a conventional binary counter which, when triggered by the output of one of the stages of counter 11, energizes the two track variation decoder input leads 33 in order to periodically energize in sequence four of the track variation lines 29 of the read only memory 18 at a rate determined by the setting of the measure select switch 34. A group of four manually operable variation switches, generally designated at 41, is connected in circuit with the variation counter 38 by a group of leads 42, each of the variation switches 41 being individually operable to actuate the variation counter 38 to energize a corresponding one of the track variation lines 29, in order to manually introduce one selected variation into a basic rhythmic pattern.

In operating the automatic rhythmic programmer of the present invention, the operator first selects the desired basic rhythmic pattern on one of the pattern switches 27. The operator may introduce any one of four pattern variations into the basic rhythmic pattern by manually operating the corresponding one of the variation switches 41. If desired, the operator may initiate automatic introduction of the four pattern variations sequentially into the basic rhythmic pattern by closing the on-off switch 36 at any given time; the system will change from one variation to another at a rate selected by the position of the measure select switch 34, which determines the periodic and sequential changing of variations at rates varying from two complete cycles of four variation changes in one measure of music to one variation change every sixteen measures of music. It will be appreciated that a large number of variations of any one of the basic rhythmic patterns is possible, since the operator cannot only vary the rate of change from one variation to another, but can also initiate the cycle of four sequential variations at any given time in a basic rhythmic pattern.

Figure 2:
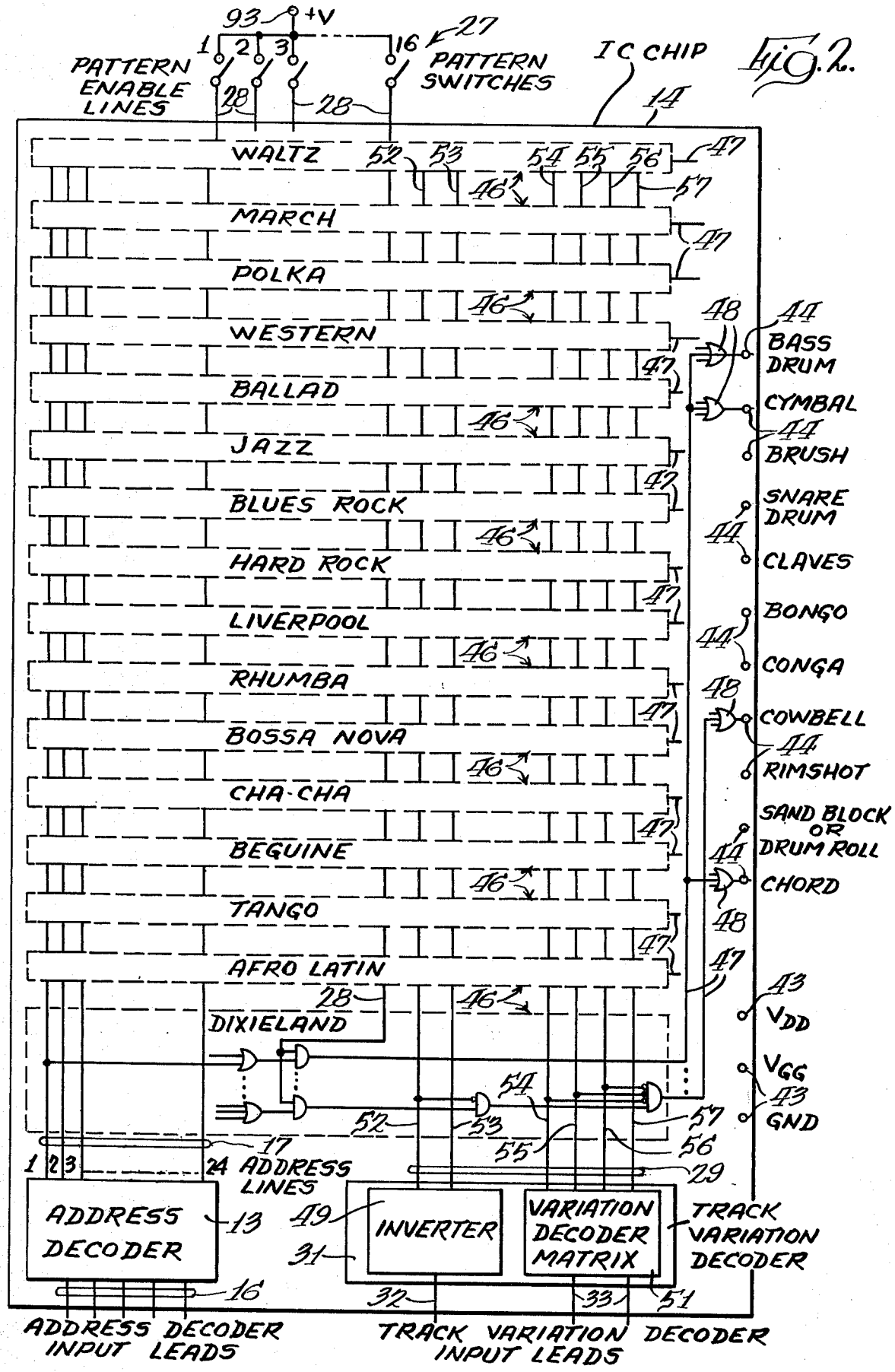
FIG. 2 is an illustration of the integrated circuit chip appearing in FIG. 1.

FIG. 2 is an illustration of the integrated circuit chip 14, which comprises in the preferred embodiment metal-oxide-semiconductor field-effect transistors (MOSFETs). The integrated circuit chip 14 has inputs, comprising the address decoder input leads 16, the track variation decoder input leads 32 and 33, the pattern enable lines 28, and voltage source inputs 43. The integrated circuit chip contains outputs 44, each being connected to one of the voice generators 19 by means of leads 21 (see FIG. 1).

The read-only memory 18 comprises 16 track groups 46, each represented by a dashed box in FIG. 2, each track group corresponding to one of 16 basic rhythmic patterns. Each track group 46 comprises approximately eleven tracks, the exact number depending upon the rhythmic pattern. The track group 46 corresponding to the dixieland rhythmic pattern is illustrated in more detail in FIG. 2 than the other track groups 46, and the detailed schematic of the logic circuitry for the dixieland track group appears in FIG. 3, as the dixieland pattern is representative of the basic rhythmic patterns made available to the present invention.

The track groups 46 are arranged within the integrated circuit chip 14 such that each track group 46 is in circuit with the address lines 17, one of the pattern enable lines 28, and the track variation lines 29. Each track group 46 is further provided with a series of track group output leads 47 which are connected to certain of the outputs 44 through output OR gates 48, only a few of which are illustrated in FIG. 2 for the dixieland track group 46.

It should be recognized that each track group 46 has output leads 47 connected to certain outputs 44 only for those voice generators 19 necessary for its corresponding particular basic rhythmic pattern. For example, the dixieland track group 46 is connected to outputs 44 for the six voice generators required for the dixieland rhythmic pattern: the bass drum, cymbal, snare drum, bongo, conga and cow bell. Furthermore, an output 44 is provided for operating a chord gate for supplying as accompaniment the chord being played at predetermined times in a measure of music in conjunction with a rhythm system on the order of that system disclosed in U.S. Pat. No. 3,567,838 to Charles J. Tennes and Donald R. Kern. Providing the root and fifth notes of the chord as bass notes according to such a system is easily accomplished by the present invention by operating the low bass gate and the high bass gate on the first and third beats of every measure respectively by direct connection (not shown) to counter 11.

Each track of a particular track group 46 is in circuit with a corresponding pattern enable line 28 and a pattern switch 27, whereby a particular track group 46 will be enabled by closing its corresponding pattern switch 27.

Each of the track variation lines 29 is supplied by the track variation decoder 31 and is connected in circuit with certain of the tracks of each track group 46, each track variation line being operable when energized to cancel or enable certain actuating pulses to the voice generators 19. The track variation decoder 31 comprises an inverter 49 in circuit with track variation decoder input lead 32, and a variation decoder matrix 51 in circuit with the two track variation decoder input leads 33. The output of the inverter 49 comprises two track variation lines 52 and 53, each of these track variation lines being periodically energized in sequence for time intervals corresponding to a measure of music in order to periodically vary the rhythmic patterns from measure to measure. The output of the variation decoder matrix 51 comprises track variation lines 54, 55, 56 and 57, each corresponding to one of four pattern variations.

The detailed operation of the preferred embodiment of the present invention will be described in conjunction with FIG. 3, which is a detailed schematic showing the logic circuitry for the track group 46 corresponding to the dixieland pattern. With additional reference to FIG. 4, the 24 address lines 17 of the read-only memory 18 are periodically energized in sequence by pulses from the master oscillator 10 in circuit with the counter 11 and the address decoder 13 at a rate determined by the setting of the tempo adjust control 58. The counter 11 comprises a group of nine series-connected flip-flop divider stages 61 through 69, the outputs of stages 61 through 65 being connected to the inputs of the address decoder 13 by means of the five address decoder input leads 16. The address decoder 13, which may comprise a matrix, is operable to decode the five counter inputs in a well-known manner into 24 addresses which represent 24 divisions of each measure of music, assuming four beats per measure. For rhythmic patterns such as the waltz in which there are only three beats per measure, the counter 11 is operable to actuate the address decoder 13 to periodically pulse in sequence only the first 18 of the address lines 17 through the use of a known counter stage resetting device (not illustrated) operated whenever any basic rhythmic pattern having three beats per measure is selected. It will be recognized that there are a variety of counters and decoders known in the art which can be used to energize the address lines 17, the details of these devices not comprising a part of the present invention.

Figure 3:
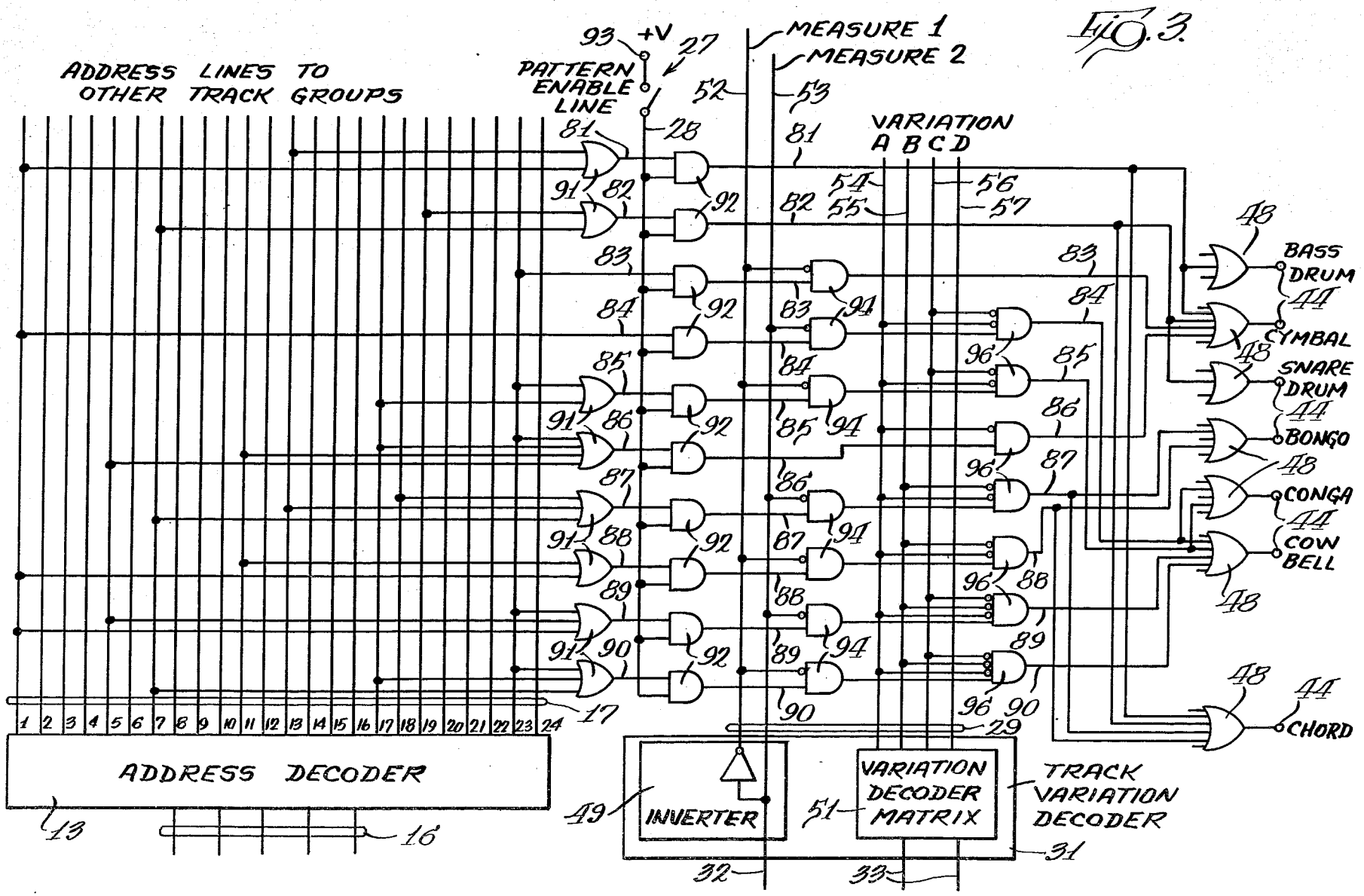
FIG. 3 is a detailed schematic diagram showing the logic circuitry for one typical basic rhythmic pattern.

As shown in FIG. 3, each of the tracks 81 through 90 of the track group 46 for the dixieland rhythmic pattern is in circuit with certain of the address lines 17, either by direct connection (tracks 83 and 84), or through the use of OR gates 91 having inputs thereof connected to certain of the address lines 17, the output of each OR gate 91 being connected to a corresponding track. Each of the tracks 81 through 90 is periodically pulsed at predetermined times from the address lines 17 in circuit therewith. For example, track 88 is pulsed by the first and 11th address lines 17 at the beginning of every first and 11th subdivision of a measure of music.

Each of the tracks 81 through 90 is in circuit with one of a group of AND gates 92 corresponding to the dixieland rhythmic pattern, the pattern enable line 28 corresponding to the dixieland pattern being connected to an input of each AND gate 92, whereby the dixieland rhythmic pattern is enabled by energizing the corresponding pattern enable line from a voltage source 93 by closing its corresponding pattern switch 27. A group of AND gates is similarly provided for each of the other track groups, as noted earlier.

Certain tracks, such as tracks 81 and 82, are directly connected to output OR gates 48 without provision for varying any of the pulses thereon. For example, track 81 is connected to output OR gates 48 in circuit with outputs 44 for the bass drum, cymbal and chord; and track 82 is similarly in circuit with outputs 44 for the cymbal, snare drum and chord. With additional reference to FIG. 5, which is a chart showing two measures of the dixieland rhythmic pattern, the base drum, cymbal and chord are actuated at the first and 13th subdivisions of each measure because track 81 is in circuit with the first and 13th address lines 17, which are respectively pulsed by the address decoder 13 at the first and 13th subdivisions of each measure. Similarly, the cymbal, snare drum and the chord are pulsed at the seventh and 19th division of each measure, as track 82 is in circuit with the seventh and 19th address lines 17. The voice generator actuating pulses on the other tracks are varied as will be seen, as these tracks are in circuit with certain of the track variation lines 29.

Tracks 83 through 90 are in circuit with a group of AND gates 94, or a group of AND gates 96, or both, each of these AND gates having inputs connected to one or more of the track variation lines 29. For the dixieland rhythmic pattern, the track variation lines 29 are connected to the inputs of the AND gates 94 and 96 through inverters such that energization of a track variation line will be operable to cancel actuating pulses on those tracks in circuit therewith. For example, energization of any of track variation lines 53, 54 or 56 will cancel an actuating pulse on track 84 simultaneously occurring at the first subdivision of each measure. It is readily apparent that the dixieland rhythmic pattern can be varied by selectively energizing certain of the track variation lines 29 in order to cancel certain of the actuating pulses on tracks 83 through 90. It has been found most convenient for the dixieland pattern to introduce pattern variations by cancelling certain pulses on certain tracks of the dixieland track group 46; however, for other rhythmic patterns it might be more convenient to have energization of the track variation lines operate to enable rather than cancel actuating pulses on those tracks in circuit with the variation lines; enabling instead of cancelling is merely a matter of design choice.

Figure 4:
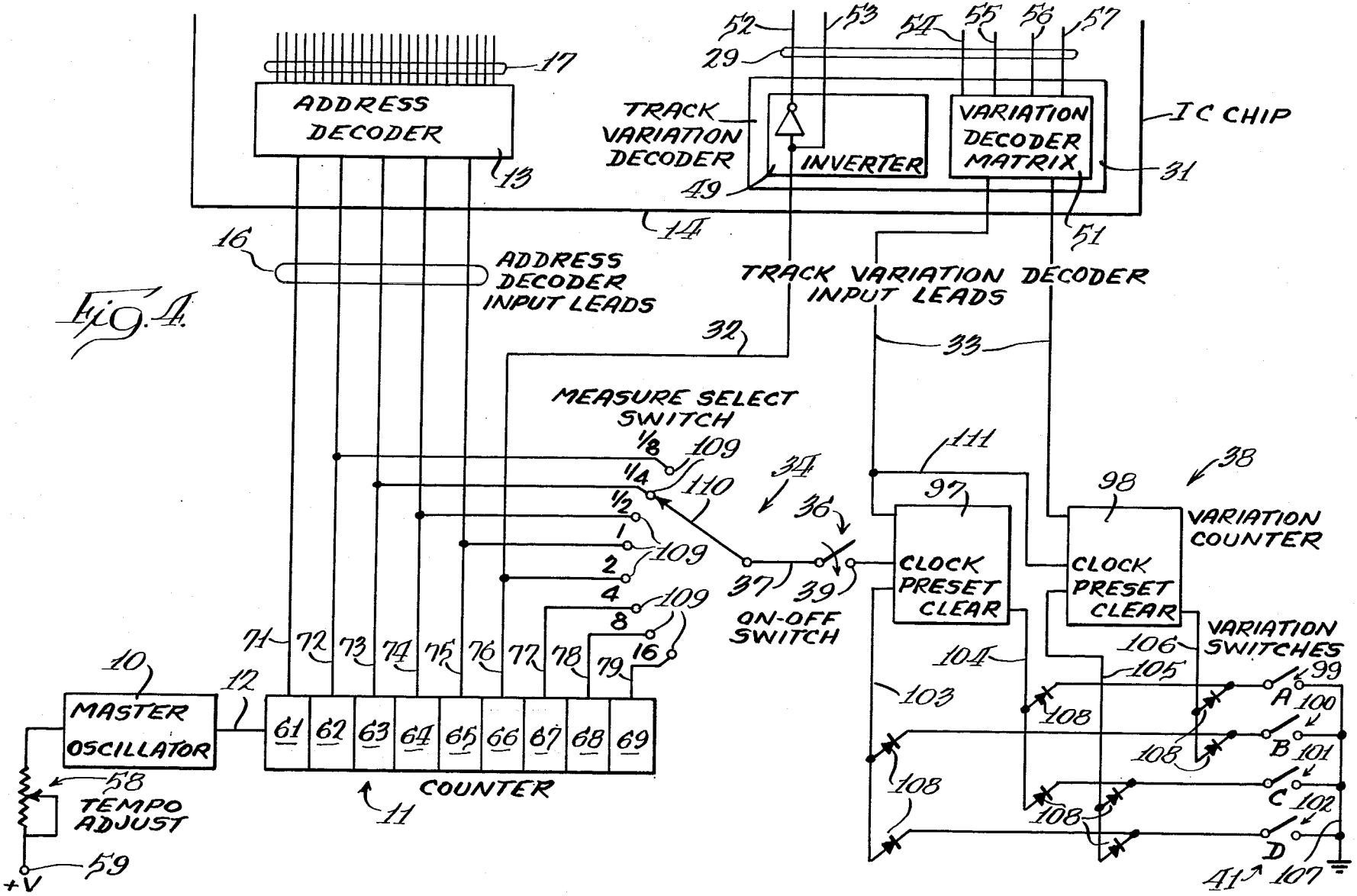
FIG. 4 is a schematic diagram illustrating the oscillator and counters shown in FIG. 1.
Figure 5:
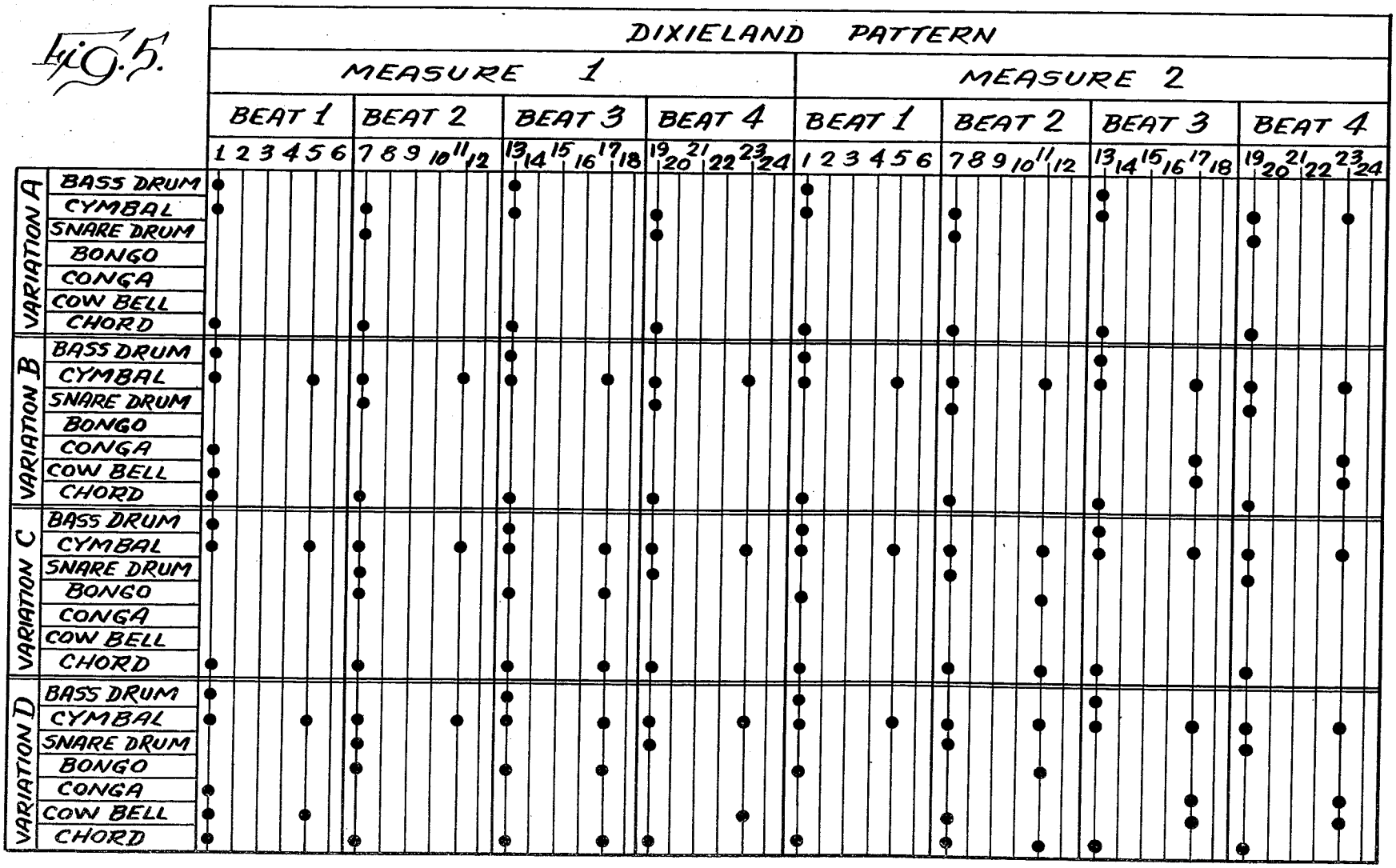
FIG. 5 is a chart corresponding to FIG. 3 showing two measures of one typical basic rhythmic pattern for each of four pattern variations.

FIG. 4 illustrates the electronic circuitry for energizing the track variation lines 29. The output lead 76 of divider stage 66 of the counter 11 is connected to the track variation decoder input lead 32 for periodically energizing track variation lines 52 and 53 by means of the inverter 49 for varying the rhythmic patterns periodically from measure to measure. For a series of two successive measures, track variation line 52 is in logic state one of the first of two such measures, and track variation line 53 in logic state one only for the second of the two measures. Track variation lines 54, 55, 56 and 57 are individually energized in order to provide variations A, B, C and D respectively. Two measures of the dixieland rhythmic pattern for each of these four variations are illustrated by the chart of FIG. 5.

It will be noted from FIG. 3 that track variation line 57 corresponding to variation D is not in circuit with any of the tracks of track group 46 for the dixieland rhythmic pattern, this being merely a matter of design choice.

The variation decoder matrix 51 is operable to energize one of the track variation lines 54, 55, 56 or 57 in response to one of four possible combinations of logic states on the track variation decoder input leads 33. There are four such possible combinations: both leads 33 can be in logic state zero, both can be in logic state one, and either one of the leads 33 can be in logic state zero with the other lead being in logic state one. The variation decoder matrix 51 decodes these four possible combinations in a manner well-known in the art. The inverter 49 and the variation decoder matrix 51 are preferably contained within the integrated circuit chip 14 only for the purpose of minimizing the number of chip input leads.

The track variation decoder input leads 33 can be manually energized according to any one of the four combinations of logic states in order to energize one of four track variation lines 54, 55, 56 or 57 corresponding to one preselected pattern variation. The track variation decoder input leads 33 can also be energized automatically according to repeated sequences of all four logic state combinations at a preselected rate in order to periodically energize in sequence the track variation lines 54, 55, 56 and 57 by means of the variation counter 38, which comprises two flip-flop divider stages 97 and 98.

The automatic energization of the track variation lines 29 produces patterns developed at the voice generators which are the resultant of varying patterns of actuating pulses on the tracks according to the sequence of energization of the track variation lines 29.

Each of the flip-flop stages 97 and 98 has three conventional input terminals: the clock terminal, for triggering the flip-flop; the preset terminal, which when grounded, sets the flip-flop to logic state one; and the clear terminal, which when grounded, sets the flip-flop to logic state zero. The group of four variation switches generally designated at 41 comprises switches 99, 100, 101 and 102 corresponding to variations A, B C and D respectively. The variation switches 41 are in circuit with both flip-flop stages 97 and 98 of the variation counter 38, and are individually operable to manually produce any one of four possible logic state combinations on the track variation decoder input leads 33 to energize one of the track variation lines 54, 55, 56 and 57 corresponding to the selected pattern variation. Closing one of the variation switches 99, 100, 101 or 102 connects either the preset or the clear input terminal of the flip-flop stages 97 and 98 to ground lead 107 through a diode 108. For example, closing switch 100 corresponding to variation B operates to ground the preset terminal of flip-flop stage 97 and the clear terminal of flip-flop stage 98, with the result that the flip-flop stage 97 is set into logic state one and flip-flop state 98 is set into logic state zero, the variation decoder matrix 51 then operating to energize track variation line 55 corresponding to variation B. The variation switches 41 are preferably pushbutton switches of the momentary contact type such that closing any one variation switch will maintain a corresponding track variation line energized until the switch is released and a pulse from the counter 11 triggers the variation counter 38 to energize another track variation line.

The track variation lines 54, 55, 56 and 57 can be periodically energized in sequence automatically by triggering the variation counter 38 from the counter 11 at a preselected rate determined by the setting of the multiple-position measure select switch 34. Each of the outputs 72 through 70 of respective stages 62 through 69 of counter 11 is connected to one of the terminals 109 of the measure select switch 34, each of the terminals 109 being selectively coupled to the clock terminal input of flip-flop stage 97 by means of a rotatable arm 110 of the measure select switch 34 and the on-off switch 36. The output of flip-flop state 97 is connected to the clock terminal input of flip-flop stage 98 by means of an output lead 111. The measure select switch is selectively operable to actuate the variation counter 38 to sequentially energize the track variation lines 54 through 57 at rates designated in FIG. 4 adjacent to the terminals 109: the variations can be changed at rates ranging from once every 16 measures (by coupling counter output 79 to flip-flop stage 97) to once every one-eighth of a measure, which is every one-half beat, assuming four beats per measure (by coupling counter output 72 to flip-flop stage 97).

The on-off switch 36 is selectively operable to commence the automatic sequential energization of the track variation lines at any given time in a basic rhythmic pattern such that the rhythmic patterns developed at the voice generators are varied in accordance with the relative timing of the sequential energization of the address lines 17 and the sequential energization of the track variation lines 54, 55, 56 and 57.

It is readily apparent that many possible pattern variations are available, because the operator cannot only determine at what rate the variations are sequentially changed, but can also determine at what point in a basic rhythmic pattern the cycle of variation changes can be initiated. For example, by setting the measure select switch 34 to change variations every one-fourth of a measure (assuming four beats per measure), each of the four possible variations will be introduced into the basic rhythmic pattern for one full beat of the measure, beginning at any given time which is determined by closing on-off switch 36. Similarly, when the measure select switch 34 is set to change variations every one-eighth of a measure, each variation will likewise be introduced for only one-half beat of a measure, each one-half beat comprising three of the 24 subdivisions of a four-beat measure. A group of four lights (not illustrated) can be connected to the flip-flop stages to indicate to the operator which variation is being used at any given time.

As illustrated by the following table in which two measures of a rhythmic pattern are represented, the four variations being denoted by A, B, C and D, setting the measure select switch 34 to change variations every one-fourth of a a measure (assuming four beats per measure) allows the operator to obtain one of four different two-measure pattern sequences depending upon the timing of closing on-off switch 36 or actuating one of the variation switches 41, alternate measures of each such two-measure sequence usually differeing from one another.

| Measure 1 | | | | Measure 2 | | | |
|---|---|---|---|---|---|---|---|
| Beat 1 | Beat 2 | Beat 3 | Beat 4 | Beat 5 | Beat 6 | Beat 7 | Beat 8 |
| A | B | C | D | A | B | C | D |
| B | C | D | A | B | C | D | A |
| C | D | A | B | C | D | A | B |
| D | A | B | C | D | A | B | C |

The possible number of different two-measure pattern sequences varies with certain settings of the meausre select switch 34 in order to provide the operator with many different pattern variations.

FIG. 5, which is a chart showing two measures of the dixieland rhythmic pattern for each of the four possible variations, illustrates the musical effects of individually energizing each of the track variation lines corresponding to one of the four variations with measure to measure variation. It should be noted that the basic beat of the dixieland pattern is maintained throughout each of the four variations, each variation operating to modify or cancel actuating pulses for certain non-essential voice generators.

It is apparent that more than four variations could be introduced into any of the basic patterns, the preferred embodiment being thought to be the best compromise between the complexity of the logic circuitry and the most desirable number of variations.

Figures 6, 7, 8:
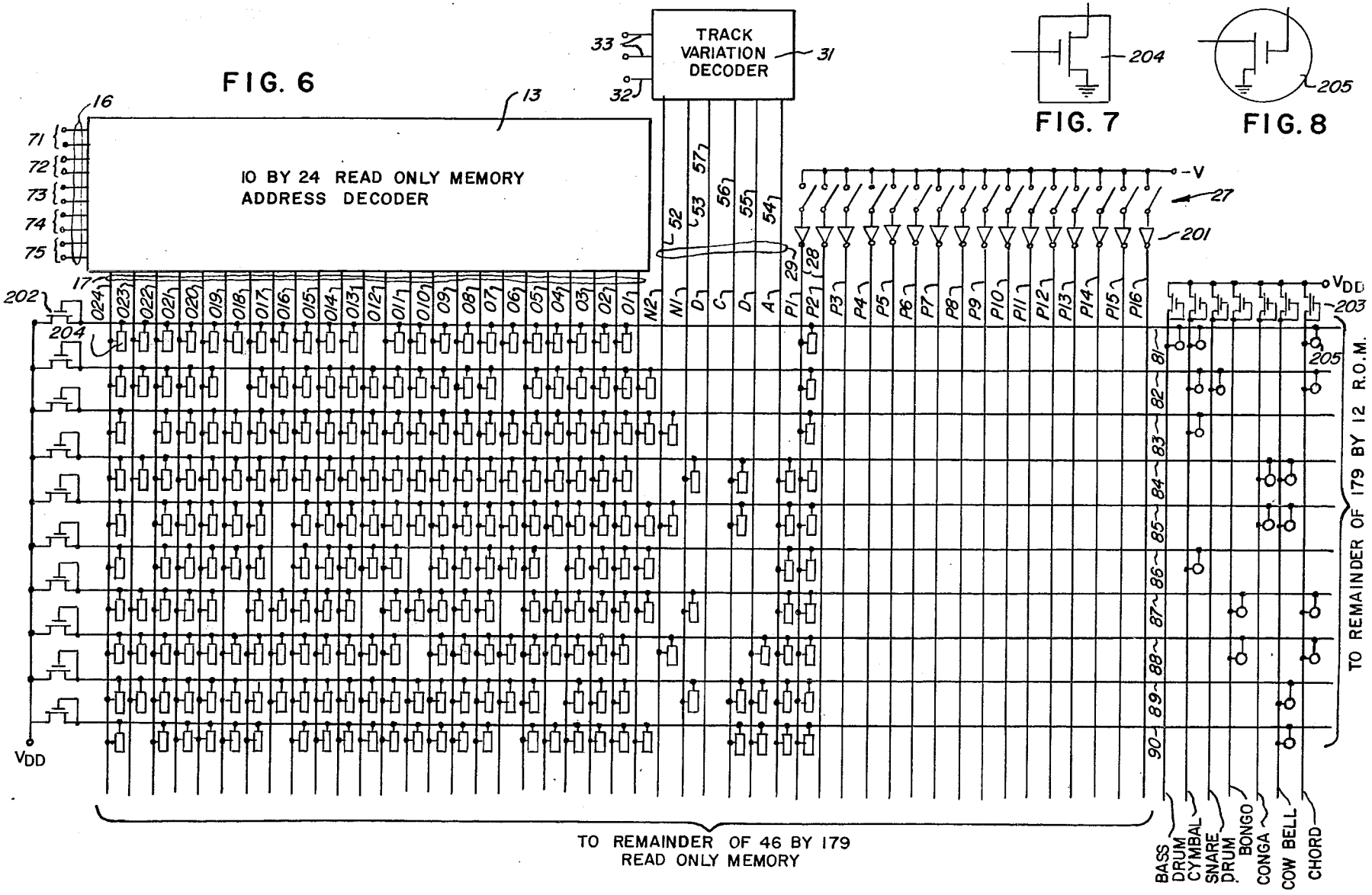
FIG. 6 is a schematic diagram of the circuitry of the integrated circuit chip shown in FIG. 1.
FIGS. 7 and 8 are representative circuit elements shown in block form in FIG. 6.

FIG. 6 illustrates a preferred approach to the actual read-only memory circuitry on a large scale integrated circuit chip. The various portions of the circuitry shown in FIG. 6 correspond to that shown in FIG. 3 and are similarly designated with reference numerals. FIGS. 7 and 8 illustrate the circuitry in the blocks and circles shown in FIG. 6.

From FIG. 6 it can be seen that the patterns of pulses on rhythm tracks 81–90 are developed in response to three sets of address signals. A first set of address signals on lines 01 to 024 comprise a repetitive sequence of individual pulses on successive lines. A second set of address signals appears on lines 52–57 as previously described in connection with FIG. 3. A third set of address signals appears on lines 28, also designated P1 to P16 and comprise logic signals controlled by manual switches 27.

A field effect transistor (FET) within the small rectangular blocks 204 (as shown in FIG. 7) function to ground an associated signal track lead in response to a signal applied to the gate electrode via an associated address line. Together, all of the FETs 204 associated with a particular one of the signal tracks 81–90 form, in effect, multi-input logic NAND gate, 8.3. The output on a particular signal track is a logic 0 when any of the transistors 204 coupled to it are turned on by a logic 1 signal on an associated address line, and the corresponding output is a logic 1 only when none of such transistors are turned on. To a person skilled in logic circuitry it will be immediately apparent that the NAND gate associated with each of signal tracks 81–90 in FIG. 6 performs the same overall logic function as the separate OR gates 91, AND gates 94, and AND gates 96 in FIG. 3. Similarly, the FETs 205 in FIG. 6 associated with a particular output lead to one of the tone generators function as a NOR gate which is, in essence, logically equivalent to OR gates 48 in FIG. 3.

To illustrate the foregoing, consider signal track 85. As shown in FIG. 3 signal track 85 has outputs when address lines 17 and 23 are activated provided its associated AND gate 92 is enable by switch 27 being closed, an enable signal appears on address line 53 and not 52, and enable signals do not appear on address lines 54 or 56. The same thing is true in FIG. 6. The absence of FETs connected to address lines 17 and 23 indicate that only when those address lines are activated will track 85 not be grounded in response to signals from address decoder 13. With the left-most switch 27 closed the signal through inverter 201 is a logic zero so track 85 is not grounded. With an enable signal on line 53 and not on line 52, the FET connected to line 52 will be off and track 85 will not be grounded. Also, as long as no enable signals appear on address lines 54 or 56, FETs connected thereto will be OFF and track 85 ungrounded thereby. Thus, the overall function of the track logic of FIG. 3 is identical to that of FIG. 6. The coupling of signal tracks to rhythm voice generators is also functionally the same in the FIG. 3 and FIG. 6 circuitry. Track 85 is coupled through particular OR gates 48 in FIG. 3 to conga and cow bell generators. Similarly, in FIG. 6, track 85 is coupled to two FETs 205 to cause changes in logic states on signal leads to conga and cow bell voice generators when pulses occur on track 85.

Thus, it should be apparent that the circuitry shown in FIG. 6 as implementation of this invention in an actual integrated circuit is the full equivalent of the circuitry shown in FIG. 3 as discrete logic circuitry.

We claim:

1. In an automatic rhythm system, in combination:
memory circuit means having a set of input address lines and a set of output signal lines;
first address circuit means for producing a repetitive sequence of pulses, one-at-a-time, on individual ones of a first subset of said input address lines at a preselected first rate associated with subintervals of a musical measure;
second address circuit means for producing a sequence of pulses, one-at-a-time, on individual ones of a second subset of said input address lines at a second rate programmable to be at least one of a series of different subintervals of a musical measure and a series of different multiples of a musical measure; and
third address circuit means, including a plurality of manually operable controls each producing an enabling signal on a unique one of a third subset of said input address lines;
said memory circuit means being preprogrammed to respond to at least one of said enabling signals and to said pulses on said first and second subsets of said input address lines to produce differing sequences of output pulses on at least one subset of said output signal lines associated with said enabling signal, said sequences of output pulses on each subset of said output signal lines being characteristic of an associated basic type of rhythm pattern with variations in each such pattern at said second rate.

2. The combination as claimed in claim 1, wherein said second address circuit means also produces alternating pulses on a separate pair of said input address lines at a rate of once per measure; and said memory circuit means is preprogrammed also to respond to said pulses on said pair of said input address lines to produce variations in said rhythm pattern at least as frequently as once per measure.

3. The combination as claimed in claim 1, wherein said first address circuit means comprises:
an oscillator;
a first binary counter driven by said oscillator; and
a first decoder circuit operated by said first binary counter to produce said sequence of pulses on said first subset of address lines;
and said second address circuit means comprises:
selector circuit means for deriving a sequence of pulses at a selectable rate from said first binary counter;
a second binary counter receiving said sequence of pulses from said selector circuit means; and
a second decoder circuit operated by said second binary counter to produce said sequence of pulses on said second subset of address lines.

4. The combination as claimed in claim 3, further comprising:
a set of rhythm voice generator circuits; and
circuit means for coupling each of said output signal lines of said memory circuit means to at least one of said rhythm voice generator circuits.

5. The combination as claimed in claim 4, wherein said memory circuit means comprises a preprogrammed read-only memory; and at least said read-only memory, said first and second decoder circuits, and said coupling circuit means comprise a single integrated circuit chip.

6. The combination as claimed in claim 3, further comprising:
an ON-OFF switch between said selector circuit means and said second binary counter to deactivate said counter; and
preset count circuit means for entering a preset count into said second binary counter when deactuated to select a particular one of said variations of basic rhythm patterns.

7. The combination as claimed in claim 2, wherein said first address circuit means comprises:
an oscillator;
a first binary counter driven by said oscillator; and
a first decoder circuit operated by said first binary counter to produce said sequence of pulses on said first subset of address lines;
and said second address circuit means comprises:
a second decoder circuit operated by said first binary counter to produce said alternating pulses on said pair of input address lines;
selector circuit means for deriving a sequence of pulses at a selectable rate from said first binary counter;
a second binary counter receiving said sequence of pulses from said selector circuit means; and
a third decoder circuit operated by said second binary counter to produce said sequence of pulses on said second subset of address lines.

8. The combination as claimed in claim 7, further comprising:
an ON-OFF switch between said selector circuit means and said second binary counter to deactuate said counter; and
preset count circuit means for entering a preset count into said second binary counter when deactuated to select a particular one of said variations of basic rhythm patterns, said selected variation itself varying on alternate measures according to alternate pulses from said second decoder circuit.

9. In an automatic rhythm system, in combination:
memory circuit means having a set of input address lines and a set of output signal lines;
first address circuit means for producing a repetitive sequence of pulses, one-at-a-time, on individual ones of a first subset of said input address lines at a preselected first rate associated with subintervals of a musical measure;
second address circuit means for producing a sequence of pulses, one-at-a-time, on individual ones of a second subset of said input address lines at a second rate programmable to be at least one of a series of different subintervals of a musical measure and a series of different multiples of a musical measure; and
third address circuit means, including manual control means, for producing a set of manually variable address signals on a third subset of said input address lines;
said memory circuit means being preprogrammed to respond to said pulses on said first and second subsets of said input address lines and to said manually variable address signals on said third subset of said input address lines to produce differing sequences of output pulses on said output signal lines characteristic of a preselected basic type of rhythm pattern selected by said manual control means with variations in said pattern at said second rate.

10. The combination as claimed in claim 9, wherein said second address circuit means also produces alternating pulses on a separate pair of said input address lines at a rate of once per measure; and said memory circuit means is preprogrammed also to respond to said pulses on said pair of said input address lines to produce variations in said rhythm pattern at least as frequently as once per measure.

11. In an automatic rhythm system, in combination:
a set of rhythm voice generators;
a set of output signal tracks;
rhythm pattern circuit means for producing signal pulses on said set of output signal tracks according to a preselected rhythm pattern; and
a set of actuating circuit means each associated with at least one of said signal tracks for operating a selected subset of said rhythm voice generators in accordance with signal pulses on said associated signal track;
said rhythm pattern circuit means comprising:
first address circuit means for producing a first set of address signals varying in a repetitive sequence at a preselected first rate associated with subintervals of a musical measure;
second address circuit means for producing a second set of address signals varying at a second rate programmable to be at least one of a series of different subintervals of a musical measure and a series of different multiples of a musical measure;
third address circuit means for producing a third set of address signals variable by manual control means; and
a plurality of logic circuit means each receiving, simultaneously, unique preselected subsets of said first and second and third sets of address signals for producing signal pulses on an associated one of said signal tracks at time intervals determined as a combined function of said preselected subsets, whereby a basic rhythm pattern selected by said manual control means is characterized by variations which occur at said programmed second rate.

12. The combination as claimed in claim 11, wherein said first address circuit comprises:
a first set of address lines;
an oscillator; and
first counting circuit means driven by said oscillator for producing repetitive sequences of pulses on said first set of address lines;
and said second address circuit comprises:
a second set of address lines;
selector circuit means for deriving a sequence of pulses at a selectable rate from said first counting circuit means; and
second counting circuit means driven by said pulses from said selector circuit means for producing repetitive sequences of pulses on said second set of address lines at said selectable rate.

13. The combination as claimed in claim 12, wherein said first set of address lines comprises 24 signal paths;
said first counting circuit means comprises:
a first binary counter having at least six stages; and
a first binary-to-decimal decoder circuit receiving outputs from the first five stages of said first counter to produce a repetitive sequence of pulses one-at-a-time on said 24 signal paths;
said second set of address lines comprises four signal paths;
said selector circuit means comprises a multiple pole selector switch having at least five poles each connected separately to the second through fifth stages of said first binary counter; and
said second counting circuit means comprises:
a second binary counter receiving the output of said selector switch and having at least two stages; and
a second binary-to-decimal decoder receiving outputs from said second counter to produce a repetitive sequence of pulses one-at-a-time on said four signal paths.

14. The combination as claimed in claim 13, further comprising:
an ON-OFF switch connected between said selector switch and said second binary counter for deactivating said second counter; and
a preset count circuit coupled to said second counter to preset said second counter to a selectable state comprising four manually operable variation switches and a decoding matrix coupling said switches to said second counter such that operation of each of said variation switches presets said second counter to a state associated with a particular one of four variations of said preselected rhythm pattern.

15. In an automatic rhythm system, in combination:
a set of rhythm voice generators;
a plurality of sets of output signal tracks;
rhythm pattern circuit means for producing signal pulses on said sets of output signal tracks according to preselected differing types of rhythm patterns each associated with one of said sets of output signal tracks; and
a set of actuating circuit means each associated with at least one of said signal tracks for operating a selected subset of said rhythm voice generators in accordance with signal pulses on said associated signal track;
said rhythm pattern circuit means comprising:
first address circuit means for producing a first set of address signals varying in a repetitive sequence at a preselected first rate associated with subintervals of a musical measure;
second address circuit means for producing a second set of address signals varying at a second rate programmable to be at least one of a series of different subintervals of a musical measure and a series of different multiples of a musical measure;
third address circuit means for producing a third set of address signals variable by manual control means; and
a plurality of sets of logic circuit means, each set associated with one of said sets of output signal tracks, and each of said logic circuit means in each set receiving, simultaneously, unique preselected subsets of all of said first, second, and third sets of address signals for producing signal pulses on an associated one of said signal tracks at time intervals determined as a combined function of said preselected subsets, whereby said types of rhythm patterns are selectable individually and in combination by said manual control means and each is characterized by variations which occur at said programmed second rate.

16. The combination as claimed in claim 15, wherein said first address circuit means comprises:
a first set of address lines;
an oscillator, and first counting circuit means driven by said oscillator for producing repetitive sequences of pulses on said first set of address lines;

said second address circuit means comprises:

a second set of address lines;

selector circuit means for deriving a sequence of pulses at a selectable rate from said first counting circuit means; and second counting circuit means driven by said pulses from said selector circuit means for producing repetitive sequences of pulses on said second set of address lines at said selectable rate; and said third address circuit means comprises:

a third set of address lines; and a plurality of manually operated switches, each coupled to an associated address line in said third set.

* * * * *